US006398565B1

(12) United States Patent
Johnson et al.

(10) Patent No.: US 6,398,565 B1
(45) Date of Patent: Jun. 4, 2002

(54) CONNECTOR WITH AN INSULATION SHIELD

(75) Inventors: Thomas A. Johnson, Draper; Steven Lo Forte, Copperton; Ryan Kunz, Roy; Gary Stout, Farmington, all of UT (US)

(73) Assignee: 3Com Corporation, Santa Clara, CA (US)

( * ) Notice: Subject to any disclaimer, the term of this patent is extended or adjusted under 35 U.S.C. 154(b) by 63 days.

(21) Appl. No.: 09/687,228

(22) Filed: Oct. 12, 2000

(51) Int. Cl.[7] ..... H01R 13/44
(52) U.S. Cl. ..... 439/131; 439/676
(58) Field of Search ..... 439/131, 137, 439/138, 676, 946

(56) References Cited

U.S. PATENT DOCUMENTS

| | | | | |
|---|---|---|---|---|
| 2,916,720 A | | 12/1959 | Steans | 339/91 |
| 4,186,988 A | | 2/1980 | Kobler | 339/176 MP |
| 4,241,974 A | | 12/1980 | Hardesty | 339/154 A |
| 4,303,296 A | | 12/1981 | Spaulding | 339/122 R |
| 4,352,492 A | | 10/1982 | Smith | 273/1 GC |
| 4,407,559 A | | 10/1983 | Meyer | 339/126 R |
| 4,428,636 A | | 1/1984 | Kam et al. | 339/97 P |
| 4,710,136 A | | 12/1987 | Suzuki | 439/374 |
| 4,778,410 A | | 10/1988 | Tanaka | 439/676 |
| 4,915,648 A | | 4/1990 | Takase et al. | 439/490 |
| 5,035,641 A | | 7/1991 | Van-Santbrink et al. | 439/329 |
| 5,051,099 A | | 9/1991 | Pickles et al. | 439/108 |
| 5,139,439 A | | 8/1992 | Shie | 439/359 |
| 5,183,404 A | | 2/1993 | Aldous et al. | 439/55 |
| 5,184,282 A | | 2/1993 | Kaneda et al. | 361/395 |
| 5,336,099 A | | 8/1994 | Aldous et al. | 439/131 |
| 5,338,210 A | | 8/1994 | Beckham et al. | 439/131 |
| 5,391,094 A | | 2/1995 | Kakinoki et al. | 439/638 |
| 5,395,268 A | * | 3/1995 | Okada | 439/676 |
| 5,411,405 A | | 5/1995 | McDaniels et al. | 439/131 |
| 5,481,616 A | | 1/1996 | Freadman | 381/90 |
| 5,499,923 A | | 3/1996 | Archibald et al. | 439/26 |
| 5,505,633 A | | 4/1996 | Broadbent | 439/329 |
| 5,509,811 A | | 4/1996 | Homic | 439/55 |
| 5,538,442 A | | 7/1996 | Okada | 439/676 |
| 5,547,401 A | * | 8/1996 | Aldous et al. | 439/676 |
| 5,561,727 A | | 10/1996 | Akita et al. | 385/88 |
| 5,562,504 A | | 10/1996 | Moshayedi | 439/638 |
| 5,608,607 A | | 3/1997 | Dittmer | 361/686 |

(List continued on next page.)

FOREIGN PATENT DOCUMENTS

| | | |
|---|---|---|
| EP | 0 355 413 | 7/1989 |
| JP | 58-34370 | 5/1983 |
| JP | 61-256850 | 11/1986 |
| WO | WO 95/13633 | 5/1995 |

OTHER PUBLICATIONS

IBM Technical Disclosure Bulletin, "Electrical Connector For Flat Flexible Cable," vol. 25, No. 1, Jun. 1982.

*Primary Examiner*—Brian Sircus
*Assistant Examiner*—Thanh-Tam Le
(74) *Attorney, Agent, or Firm*—Workman, Nydegger & Seeley

(57) ABSTRACT

A media connector including a shield. The media connector includes an arch formed within the media connector. The arch has pin guides that allow the contact pins to be properly positioned within the media connector. The pin guides also keep the contact pins from touching each other. The arch forms an arch channel through which the shield exits the media connector. The shield extends out beneath the media connector beyond the portion of the contact pins that are exposed for contact with contacts of a media plug. When the media plug is inserted in the media connector, the shield covers the electrical connection thus formed to provide both protection and insulation of the electrical connection. The arch also includes a groove that permits the shield to rest within the confines of the media connector when the media connector is retracted.

20 Claims, 4 Drawing Sheets

U.S. PATENT DOCUMENTS

| | | | | | |
|---|---|---|---|---|---|
| 5,634,802 | A | | 6/1997 | Kerklaan | 439/131 |
| 5,660,568 | A | | 8/1997 | Moshayedi | 439/654 |
| 5,667,390 | A | | 9/1997 | Keng | 439/76.1 |
| 5,667,395 | A | | 9/1997 | Okada et al. | 439/131 |
| 5,679,013 | A | | 10/1997 | Matsunaga et al. | 439/144 |
| 5,727,972 | A | | 3/1998 | Aldous et al. | 439/655 |
| 5,773,332 | A | | 6/1998 | Glad | 439/344 |
| 5,797,771 | A | | 8/1998 | Garside | 439/610 |
| 5,816,832 | A | | 10/1998 | Aldous et al. | 439/131 |
| 5,980,322 | A | * | 11/1999 | Madsen et al. | 439/621 |
| 6,115,256 | A | * | 9/2000 | Centofante | 361/737 |
| 6,116,927 | A | * | 9/2000 | Johnson et al. | 439/131 |
| 6,217,352 | B1 | * | 4/2001 | Oliphant et al. | 439/131 |

* cited by examiner

CONNECTOR WITH AN INSULATION SHIELD

RELATED APPLICATIONS

This application is related to copending application Ser. No. 09/681,233, entitled "Electrical Compression Connection for Retractable Connectors," filed concurrently herewith and commonly assigned with the present invention and incorporated herein by reference.

BACKGROUND OF THE INVENTION

1. The Field of the Invention

The present invention relates to the field of computers. More particularly, the present invention relates to media connectors providing an electrical connection for a computer card and specifically to insulating the electrical connections formed with media connectors.

2. The Prior State of the Art

Laptop or notebook computers typically have one or two slots to receive computer cards that expand the capabilities of the laptop computer. These cards typically comply with the Personal Computer Memory Card International Association (PCMCIA) standard, which specifies both software and hardware requirements for those computer cards. Often, computer cards such as network interface cards (NICs) or modem cards are used to allow or facilitate communication with an external system or device such as the Internet or the public telephone network.

The ability to communicate with the external system, however, relies on connectors that provide an electrical connection between the computer card and the external system. For example, the public telephone system is usually accessed through wall jacks that are designed to receive RJ series media plugs. Understandably, the connector of a modem card that is connecting with the public telephone system is also configured to receive an RJ series media plug. The physical shape of the connector can be varied to accommodate other types of plugs and to enable connections with different systems.

When the media plug is removably connected with the computer card's connector, an electrical connection is formed at this interface that permits the card to electrically communicate with the external system, which can be a network, the public telephone system, or the like. In one example, the card's connector has an aperture formed in the body of the connector that is shaped and sized to removably receive a similarly shaped and sized media plug. As previously described, the aperture is often shaped and configured to receive RJ type media plugs. Contact pins, which are attached to the connector, extend freely into the aperture of the connector that receives the media plug. The media plug has contacts that are positioned on the media plug to come into contact with the contact pins when the media plug is inserted into the connector. The physical contact between the contact pins and the media plug contacts forms the electrical connection through which the computer card can communicate with the external system.

It is important to ensure that the contact pins do not fracture or otherwise malfunction in order to maintain an effective electrical connection. Because a media plug is repeatedly inserted and removed from a media connector, the contact pins are usually designed to move within a prescribed range of motion and if the movement of the contact pins exceeds this limited range of motion, the contact pins may fracture or otherwise malfunction.

Similarly, hindering the movement or flexibility of the contact pins can cause the contact pins to fracture or otherwise malfunction.

Another problem associated with the contact pins is the ability to properly position the contact pins within the media connector. Sometimes, one or more of the contact pins can be moved or shifted to a different position. This presents at least two problems. First, the misplaced contact pins can come into contact with other contact pins, which often results in an electrical short. Second, the misplaced contact pins may not come into contact with a corresponding contact of a media plug. In this instance, the electrical connection is not formed at the media connector and the card is not in electrical communication with the external system.

Further, when a media plug is inserted into a media connector, the electrical connections are usually not protected or insulated. Because the electrical connections are effectively exposed, a number of different problems can occur. For example, if a user attempts to retract the connector into the computer card without removing the media plug from the connector, it is possible for the contact pins or the media plug contacts to touch or contact the case or housing of the computer card. Usually, the housing of the computer card is made of conductive metal and electrical damage can result to both the user and the computer card if the contact pins touch the housing of the computer card. Alternatively, a user can inadvertently place a finger on the exposed electrical connection, which can result in a shock to the user or in electrical damage to the computer or the computer card.

Therefore, it would be an advancement in the art to provide a connection system that facilitates an insulation of conductive pins from the electronic device housing and further facilitates deflection of contact pins without subjecting them to excessive stress and strain.

SUMMARY OF THE INVENTION

The present invention provides a protective element to media connectors such that the electrical connections formed by the union of a media plug and a media connector are protected and insulated. This is accomplished with a shield that extends from the media connector to protect and insulate the electrical connection between the media connector and the media plug. The present invention also provides a guide element that properly positions the contact pins of a media connector, thereby ensuring that a proper electrical connection is established with a media plug.

The present invention has been developed in response to the current state of the art, and in particular, in response to these and other problems and needs that have not been fully or completely solved by currently available connectors. In one embodiment, the media connector includes an arch disposed within the body of the media connector. The contact pins of the media connector that electrically touch the contacts of the media plug extend over the arch and into an aperture of the media connector. The arch includes guide ribs to ensure that the contact pins do not touch each other and to ensure that the contact pins are properly positioned.

The shield is positioned beneath the arch with respect to the contact pins and extends out from the body of the media connector beneath the contact pins. Because the shield is beneath the arch, the shield does not interfere with the mechanical and electrical operation of the contact pins, and as a result, the movement of the contact pins is not hindered by the shield and the contact pins are therefore less likely to fracture or otherwise malfunction. Also, the shape of the shield does not have to be altered in order to accommodate the contact pins because the shield and the contact pins are positioned on opposite sides of the arch.

The shield is made of a relatively stiff material that does not become misshaped during use. The stiffness of the shield ensures that the electrical connection between the media connector and the media plug will be covered and that the shield will not fall away from the electrical connection. In effect, the stiffness of the shield ensures that the shield will exert a slight pressure against the contact pins without interfering with their movement as the media plug is repeatedly inserted and removed from the media connector.

The shield exits the media connector through an arch channel. The arch includes an arch exit channel shaped such that the shield will be flush with a surface of the media connector when the media connector is in a retracted position. In other words, because the shield exits the body of the media connector, the added thickness of the shield can potentially interfere with the retraction of the media connector. The arch exit channel permits the media connector to be easily retracted and extended by allowing the shield to move within the confines of the media connector during retraction.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention relates to a media connector for use in shielding, protecting and insulating an electrical connection formed between a media connector and a media plug. The present invention is described in terms of a media connector for use with a computer card, but it is understood that the teachings of the present invention extends to electronic devices employing retractable media connectors. The present invention is therefore not limited to use with a computer card.

Figure 1:
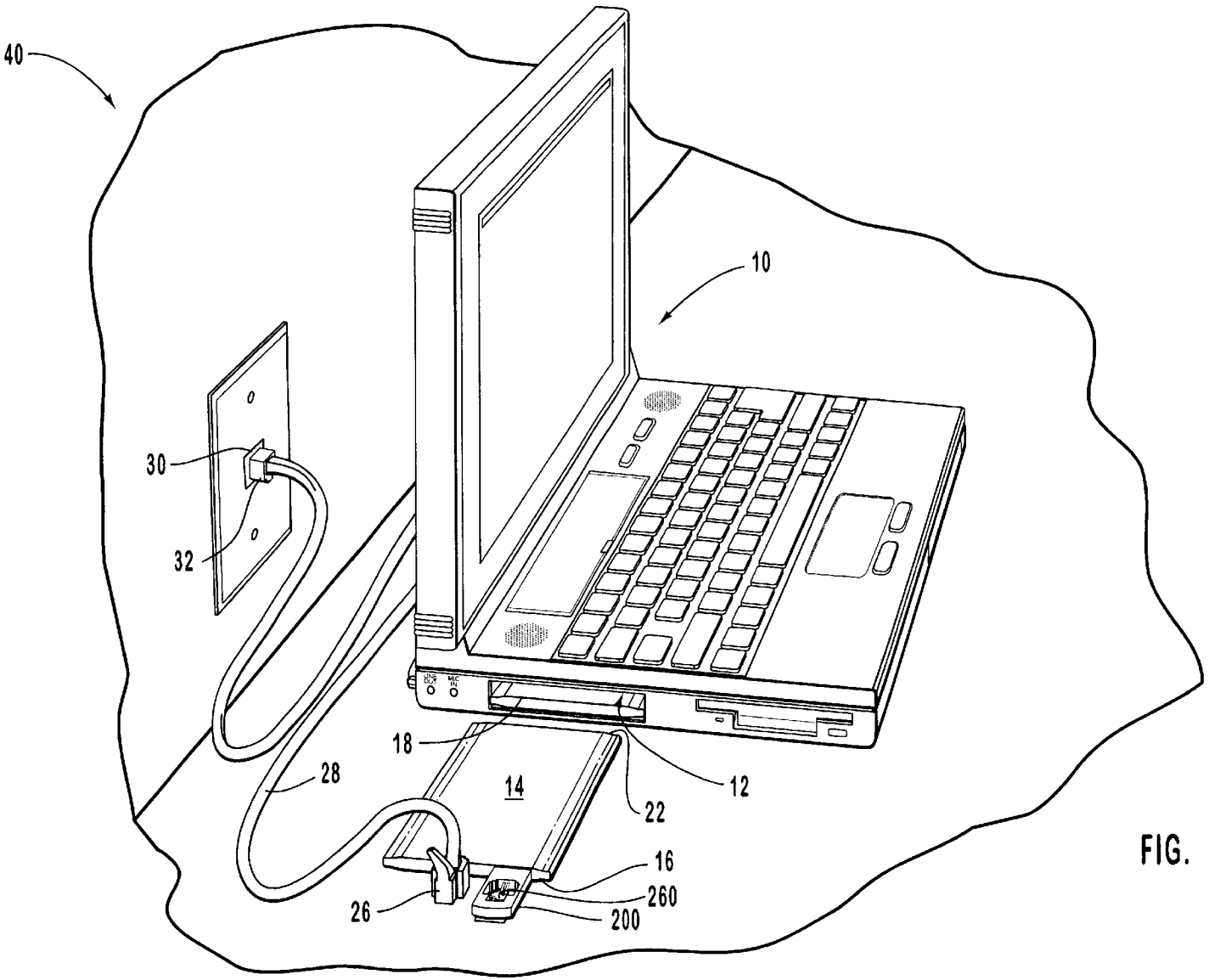
FIG. 1 illustrates an exemplary system that provides a suitable operating environment for the present invention.

While the present invention can be adapted to may different electronic devices such as audio equipment, video equipment, Internet devices and the like, FIG. 1 illustrates a typical environment in which the present invention can be implemented. FIG. 1 illustrates a computer 10 having a PCMCIA slot 12. The computer 10 is usually a portable or notebook computer and the slot 12 is capable of receiving any PCMCIA compliant card such as a modem card 14. The modem card 14 is PCMCIA compliant and has an edge connector 22 formed on one end of the modem card 14, which is configured to detachably connect with a corresponding connector slot (not shown) disposed in the slot 12. In this way, the modem card 14 may be electrically connected with the computer 10.

On the other end of the modem card 14 is a media connector 200 that serves as a mechanical and electrical interface between the modem card 14 and an external network such as the public telephone network. FIG. 1 also illustrates a media connector 200 that is extended from the body of the modem card 14. The media connector 200 may also be retracted within the body of the modem card 14. In this example, the media connector 200 is illustrated as being configured to receive an RJ-type media plug, but the media connector 200 is intended to be illustrative of a wide variety of connectors, including other RJ type sockets, 15 pin connectors, coaxial cable connectors, ethernet connectors and the like.

More specifically, the media connector 200 is configured to detachably receive a media plug 26 and wire 28 assembly as illustrated. When the media plug 26 is inserted in the media connector 200, an electrical connection is formed between the media plug 26 and the media connector 200. As used herein, "electrical connection" refers, both individually and collectively, to the physical or electrical contact between the media connector contact pins and the corresponding contacts on the media plug. In this example, the electrical connection thus formed is shielded, insulated and/or protected by a shield 260, which effectively covers the electrical connection when the media plug 26 is inserted in the media connector 200.

In this illustration, the media plug 26 is an RJ-45 plug and the media connector 200 is sized and shaped to receive the media plug 26. The wire 28 can be coaxial cable, 10baseT wire, or any other wire used for networks or electrical communication. The other end of the wire 28 is connected to the plug 32 which is configured to detachably mate with the jack 30. The jack 30 may be electrically connected to a network, the public telephone lines, or to other systems. In this embodiment, the jack 30 is electrically connected to the public telephone network. In this manner, the media connector 200 permits the modem card 14 to be electrically connected to and in communication with the public telephone system.

Figure 2:
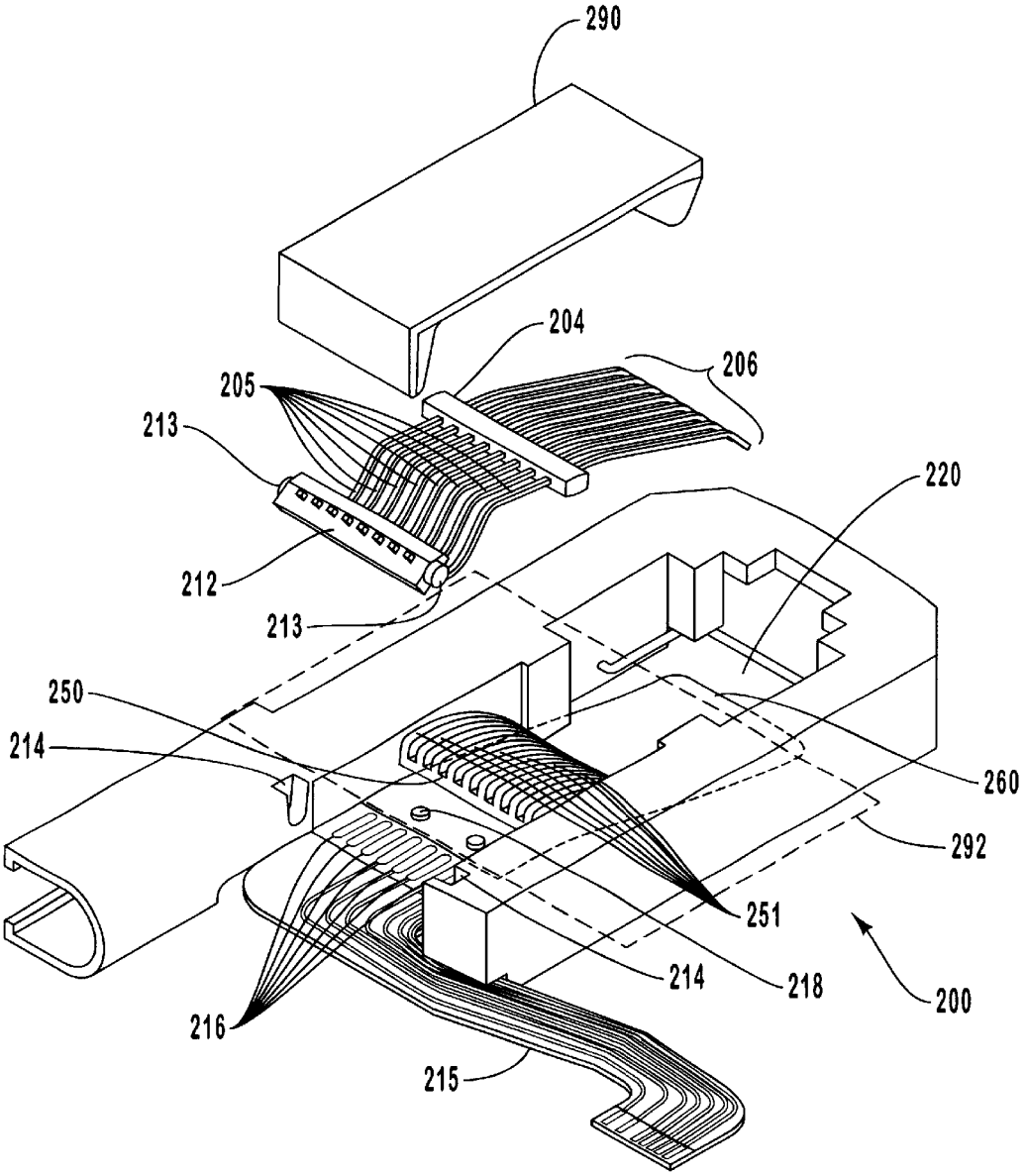
FIG. 2 is an expanded perspective view of a media connector that includes an arch disposed within a body of the media connector and a shield that extends beneath the media connector.

FIG. 2 illustrates an expanded perspective view of a media connector including a shield. As described above, the media connector 200 often serves as an interface between a computer card, such as a modem or network interface card, and an external system, such as the telephone network or a computer network. When the media connector 200 is extended from an electronic device such as the modem card 14, an electrical connection may be established at the media connector 200 by inserting a media plug or other suitable connector. When the media connector 200 is retracted within the electronic device, an electrical connection is not usually needed. The media connector 200 therefore provides for electrical communication between the modem card 14 and the external system in this example.

The media connector 200 includes a plurality of contact pins 205 that are separated from one another using an arm 212 and a spacer 204. In FIG. 2, the contact pins 205 are illustrated separate from the media connector 200 for clarity. The arm 212 that helps to separate the individual contact pins 205 has opposing extensions 213 that are shaped and configured to rest in slots 214 of the media connector 200. When the extensions 213 rest in the slots 214, each of the contact pins 205 forms an electrical connection with a corresponding trace 216 of flex circuit 215. Normally, each trace of the flex circuit 215 is enclosed within the flex circuit 215, but each trace 216 is exposed at the point 217 (shown in FIG. 3) of contact with the contact pins 205. The cover 290, also shown separated from the media connector 200 for clarity, may be connected to the media connector 200 to securely enclose the contact pins 205 within the media connector 200. Additionally, the cover 290 prevents inadvertent contact with the exposed portion of the traces 216.

When the media connector 200 is assembled, the fingers 206 of the contact pins 205 extend into an aperture 220 formed in the media connector 200. The aperture 220 shown in this example is shaped and configured to removably receive a media plug (shown in FIG. 1). The contact pins 205 are configured to bend or flex as the media plug is inserted and removed from the aperture 220 in a manner that ensures a good electrical connection between the contact pins 205 and corresponding contacts positioned on the media plug. The contact pins 205 are preferably configured to flex within a range of motion such that the contact pins 205 do not fracture or otherwise malfunction. The motion experienced by the contact pins 205 when a media plug is removed and inserted into the aperture 220 is typically within the prescribed range of motion.

As shown in FIG. 2, the media connector 200 further includes an arch 250. The arch 250 includes a plurality of pin guides 251. When the contact pins 205 are secured within the body of the media connector 200, the pin guides 251 are shaped to ensure that the contact pins 205 are correctly positioned within the media connector 200 and that the fingers 206 are properly positioned within the aperture 220 of the media connector 200. The pin guides 251 keep the contact pins 205 properly aligned and separated because each individual contact pin rests within a separate pin guide. When the contact pins 205 are properly positioned within the pin guides 251, the spacer 204 rests against a top surface of the arch 250. Advantageously, the pin guides 251 thereby prevent the individual contact pins 205 from touching each other, which prevents electrical shorts or other malfunctions. The arch 250 is also shaped to allow the contact pins 205 to bend or flex within their prescribed range of motion as a media plug is inserted and removed from the media connector 200.

Further illustrated in FIG. 2, the media connector 200 includes a shield 260 that extends beneath the fingers 206 of the contact pins 205. The shield 260 is positioned on the opposite side of the arch 250 from the contact pins 205 and exits the media connector 200 through an arch channel described with reference to FIG. 3. One function of the shield 260 is to insulate and protect the contact pins 205 from being touched or shorted by an external source as will be more fully explained with reference to FIG. 5. More generally, the shield 260 insulates and protects the electrical connection between the media connector and a media plug.

Referring again to FIG. 2, the flex circuit 215 is secured to the media connector 200, in this example, by rivets 218, although other connectors may be used to secure the flex circuit 215 to the media connector 200. In this example, the shield 260 is an extended portion of the flex circuit 215 with the difference that no trace or other circuit element is located in the portion of the flex circuit 215 that forms the shield 260. The shield 260 thus has insulative properties. Creating the shield 260 in this manner as a portion of the flex circuit 215 facilitates manufacture of the media connector and the shield. Alternatively, the shield 260 can be constructed of an insulative material that is separate from the flex circuit 215. In this case, the shield 260 would still attach to the media connector and function as described herein.

Another advantage of the shield 260 is that it is flexible and has high material memory. In other words, the shield 260 will not deform or become misshaped with use and will function to protect and insulate the electrical connection between the media connector 200 and a media plug. As will be further explained with reference to FIG. 5, the shield 260 tends to press against the contact pins 205 or the electrical connection in a manner that insures that the electrical connection created when a media plug is inserted in the media connector is covered, protected, and/or insulated.

Figure 3:
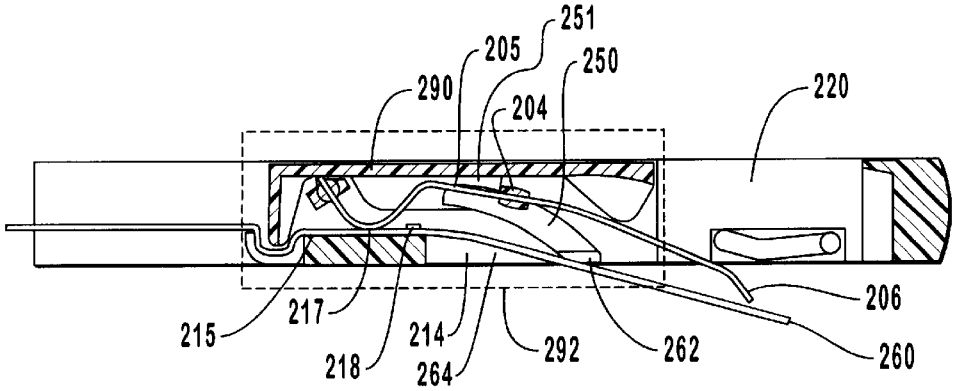
FIG. 3 is a cross sectional view of a media connector that illustrates the shield which exits the media connector through an arch channel and that illustrates the positioning of the contact pins on the opposite side of the arch from the shield.

FIG. 3 is a cross sectional view of the media connector 200 shown in FIG. 2 that more fully illustrates the structure and function of the shield 260 and the arch 250. FIG. 3 also illustrates the cover 290 and the contact pins 205 connected with the media connector 200. In FIG. 3, point 217 corresponds to the contact point between the exposed traces 216 and the contact pins 205. Because the cover 290 is securely connected with the body 292 of the media connector 200, the cover 290 partially ensures that the electrical connection at point 217 is continuous by, for example, applying pressure against the contact pins 205 to maintain physical contact between the contact pins 205 and the exposed portion of the traces 216.

The contact pins 205 extend over the arch 250 and the fingers 206 of the contact pins 205 exit the body 292 of the media connector 200 into the aperture 220. FIG. 3 also illustrates how the contact pins 205 rest within the pin guides 251 (FIG. 2), which extend outwardly from the arch 250. A portion of the contact pins 205 are contained within the body 292 of the media connector 200 and only the fingers 206 of the contact pins 205 are exposed in the aperture 220. As illustrated, the spacer 204 rests against the arch 250 and the individual contact pins are positioned within corresponding pin guides 251 of the arch 250. As previously stated, the pin guides 251 ensure that the individual contact pins 205 do not come into contact with one another and that the fingers 206 of the contact pins 205 are properly positioned within the aperture 220. Also, the contact pins 205 are not hindered in their movement by the arch 250 or the cover 290. Instead, the arch 250 is shaped to ensure that the contact pins 205 move within their prescribed range of motion as a media plug is repeatedly removed and inserted in the aperture 220 of the media connector 200.

FIG. 3 also illustrates that the media connector 200 includes an arch channel 264 beneath the arch 250. The shield 260 exits the body 292 of the media connector 200 through the arch channel 264. The shield 260 is therefore positioned beneath the arch 250 with respect to the contact pins 205. The shield 260 has sufficient length to extend beneath the fingers 206 of the contact pins 205. The shield 260 does not hinder or interfere with the movement of the contact pins 205 because the contact pins 205 are located on the opposite side of the arch 250 from the shield 260.

The media connector 200 further includes a groove 262. The groove 262 extends along a bottom portion of the arch 250 and has a depth that is substantially equal to a thickness of the shield 260, which enables the shield 260 to be accommodated within the body of the media connector 200 when the media connector 200 is retracted. The groove 262 thus ensures that the shield 260 does not interfere with the extension and retraction of the media connector 200 from an electronic device such as a computer card. The groove 262 extends along the bottom of the arch 250 and from the arch channel 264 to the aperture 220. The groove 262 also enables an end of the shield 260 to extend into the aperture 220 when the media connector 200 is retracted and the shield 260 is therefore contained within the confines of the media connector 200 when retracted. When the media connector 200 is extended, the shield 260 falls away from the media connector 200 and is positioned beneath the aperture 220 in a manner that permits the shield 260 to cover the fingers 206 when a media plug is inserted in the media connector 200.

Figure 4:
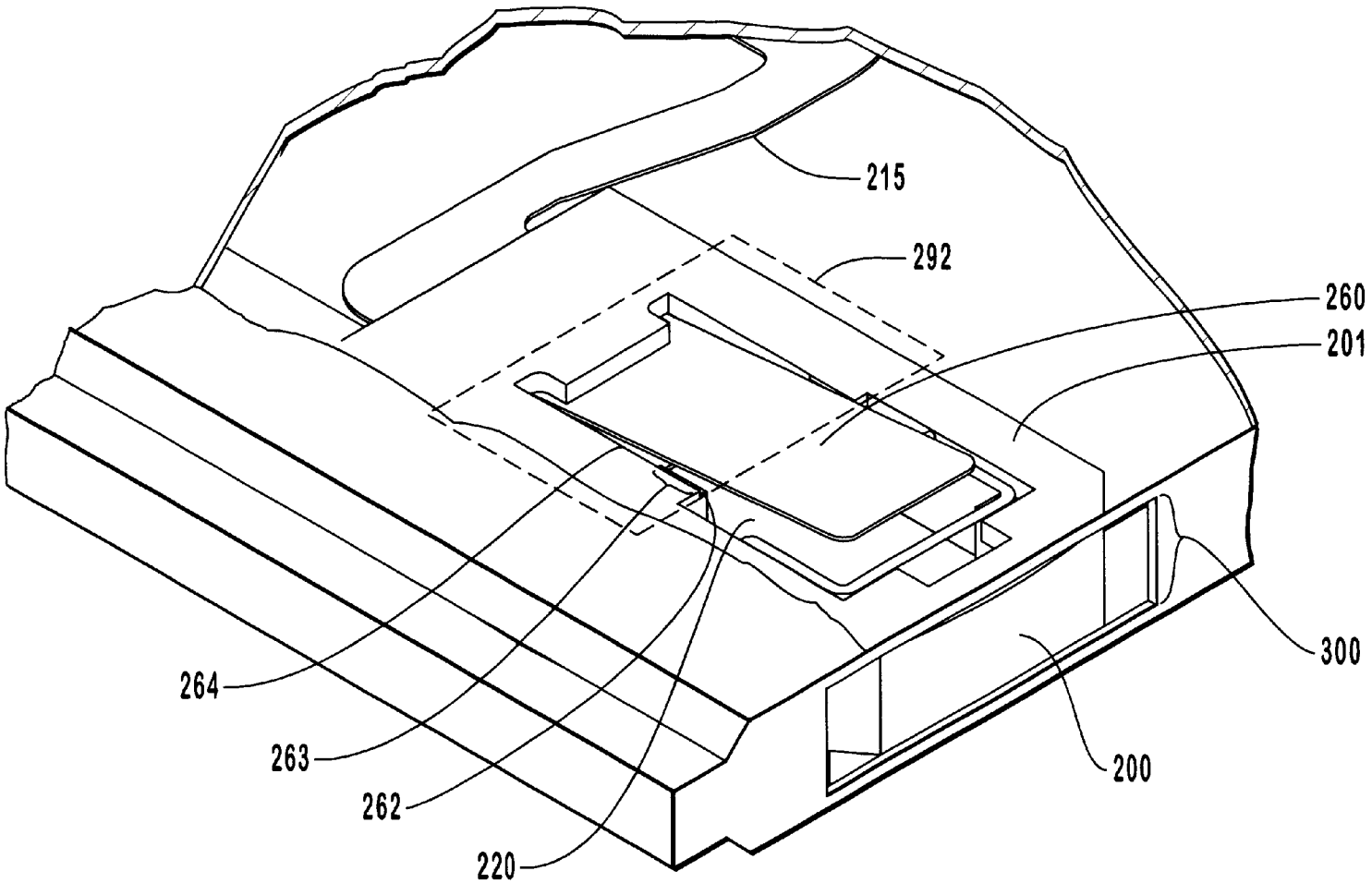
FIG. 4 is a perspective view of a media connector including a shield retracted within a computer card.

The functionality of the groove 262 is more fully illustrated in FIG. 4, which illustrates a modem card 14 including a media connector 200 in a retracted position. The modem card 14 has an opening 300 through which the media connector 200 is extended and retracted and the presence of the shield 260 can potentially prevent the media connector 200 from properly extending and retracting because of the added thickness of the shield 260.

FIG. 4 illustrates a width 263 of the groove 262 that extends from the arch channel 264 to the aperture 220. The groove 262 is located along the bottom of the arch 250 (shown in FIG. 3) and the thickness and width of the groove 262 allows the shield 260 to be flush with a surface 201 of the media connector 200 such that the extension and retraction of the media connector 200 is unaffected by the shield 260. As shown in FIG. 4, the groove 262 permits the shield 260 to lay flat within the confines of the media connector 200 and the shield 260 extends into the aperture 220 of the media connector 200 when in a retracted position. FIG. 4 also illustrates that the shield 260 exits the body 292 of the media connector 200 through the arch channel 264.

A significant advantage of having the shield 260 beneath the arch as opposed to above the arch is that the shield 260 does not interfere or hinder the movement of the contact pins that are also located above the arch. In the absence of the arch 250, the shield 260 would have to exit the body 292 at the same place as the contact pins and the shield 260 would therefore have to be cut or otherwise altered to accommodate the contact pins. Cutting or altering the shield 260 would weaken the shield and the shield is more likely to tear or otherwise malfunction.

Figure 5:
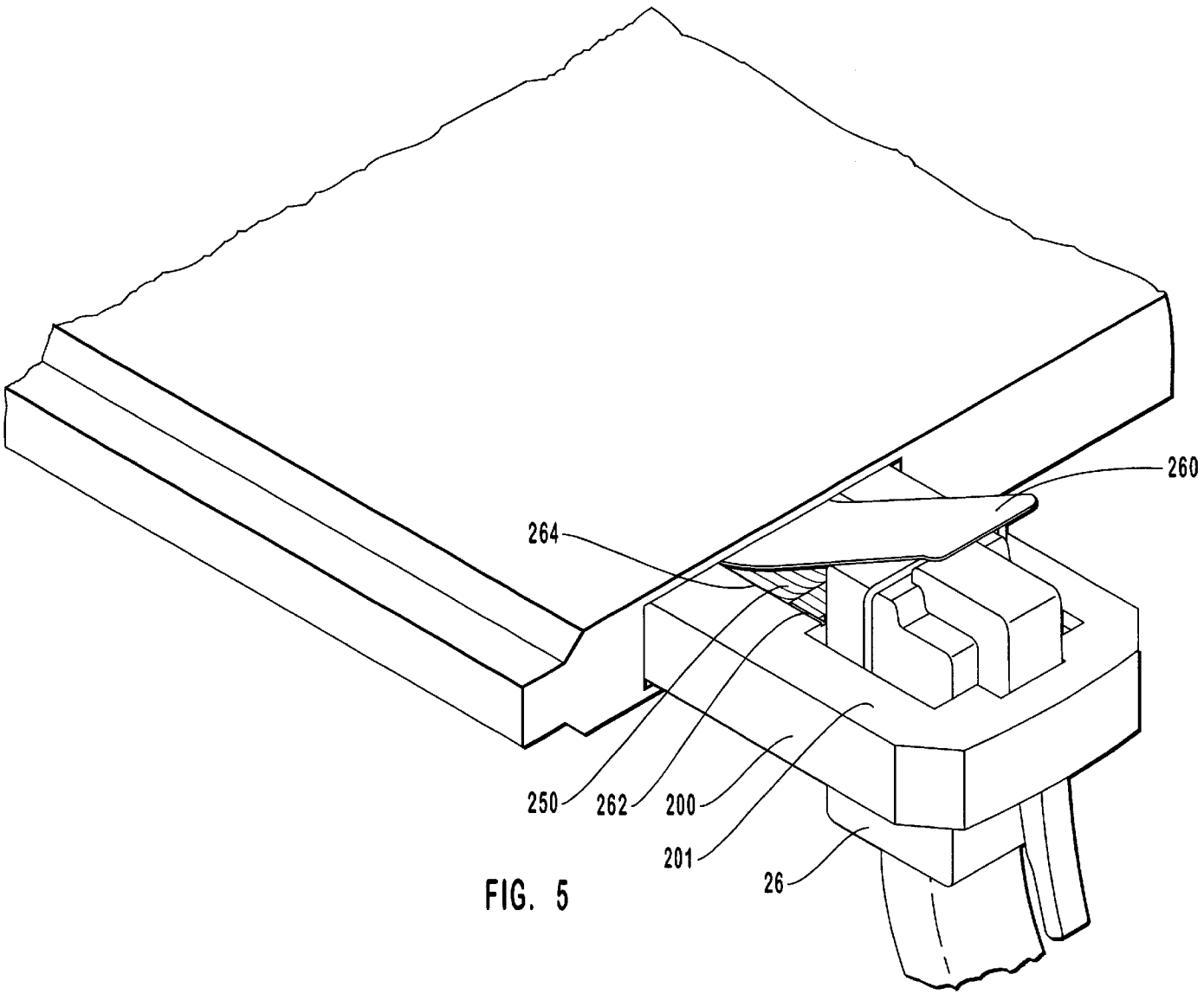
FIG. 5 is a perspective view of a shield insulating and protecting the electrical connection between a media plug and a media connector.

FIG. 5 is a perspective view of a modem card 14 having a media connector in an extended position. FIG. 5 also provides a perspective view of a media plug 26 inserted in the media connector 200. When the media plug 26 is inserted in the media connector 200, the shield 260 is positioned to cover the electrical connection between the contact pins and corresponding contacts on the media plug. The stiffness of the shield 260 causes the shield 260 to press against the media plug such that the electrical connection is not inadvertently exposed. At the same time, the shield 260 does not exert sufficient force against the contact pins to cause them to move outside of their prescribed range of motion.

In addition to insulating the electrical connection as described, the shield 260 also provides protection from inadvertent contact with the electrical connection between the media connector 200 and the media plug 26. For example, a person may attempt to grab the media connector 200 when attempting to insert or remove the media plug 26. It is possible for that person's finger to touch the electrical connection and receive a shock or cause electrical damage. The shield 260, however, prevents that person's finger from coming into contact with the electrical connection and any harm that may have been caused is avoided. In another example, it is possible that the media connector 200 may be retracted while the media plug 26 is still inserted in the media connector 200. Many computer cards have a metal body and in the absence of the shield 260, the electrical connections could be shorted by the body of the computer card in this case. In this manner, the electrical connection is insulated and protected by the shield 260 and the shield 260 prevents the electrical connection from being touched by an external objects such as a finger or the housing of the computer card.

The shield 260 thus provides insulative protection to the electrical connection between the media connector and the media plug without harming the contact pins and is an example of shielding means for insulating and protecting an electrical connection between a media connector and a media plug. The shield 260 covers the contact pins without displacing the position of the contact pins. Because the shield 260 does not place any significant force on the contact pins, they may move within their preferred range of motion and fractures or other malfunctions of the contact pins are reduced.

FIG. 5 also illustrates the groove 262. From the perspective of FIG. 5, the groove 262 is shown as a recessed portion of the media connector 200 and as described previously, this recessed portion allows the shield 260 to be flush with a surface 201 of the media connector 200 when retracted.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In a system including an electronic device and an external system, a media connector for establishing an electrical connection between the electronic device with the external system, the media connector comprising:

a retractable member having an aperture formed therein;

one or more contact pins attached to the retractable member and electrically coupled to the electronic device and flexibly extending into the aperture, the aperture being shaped to receive a media plug for electrically coupling to the external system and to establish an electrical connection between one or more contacts of the media plug and the one or more contact pins;

an arch formed in a body of the retractable member and extending into a portion of the aperture, the arch shaped to position the one or more contact pins to come into contact with the one or more contacts of the media plug and to allow radial deflection of the one or more contact pins along the arch when encountered by the one or more contacts of the media plug; and a flexible shield at least partially extending into the aperture and wherein the shield is configured to cover the electrical connection between the one or more contact pins and the one or more contacts of the media plug when the media plug is inserted in the aperture.

2. A media connector as defined in claim 1, wherein the arch further comprises one or more pin guides, wherein each of the one or more contact pins rests in one of the one or more pin guides.

3. A media connector as defined in claim 1, wherein the shield has a length that extends past the one or more contact pins extending into the aperture such that the one or more contact pins are covered by the shield.

4. A media connector as defined in claim 1, wherein the shield extends into the aperture beneath the one or more contact pins when the retractable member is retracted.

5. A media connector as defined in claim 1, wherein the shield comprises an insulative material.

6. A media connector as defined in claim 1, wherein the shield is an extension of a flex circuit that is connected to the retractable member, the flex circuit providing the electrical coupling between the one or more contact pins and the electronic device.

7. A media connector as defined in claim 1, wherein the shield has a sufficient stiffness to exert a force against the electrical connection.

8. In a system including an electronic device, a media connector for establishing an electrical connection with the electronic device, the media connector comprising:

a retractable member for connecting with the electronic device including an aperture therein;

contact pins connected to the retractable member, wherein fingers of the contact pins extend into the aperture of the retractable member, the fingers positioned to electrically come into contact with a media plug having corresponding contacts to form the electrical connection when the media plug is inserted in the aperture;

an arch formed in the retractable member and extending into a portion of the aperture to allow radial deflection of the contact pins along the arch when encountered by the corresponding contacts of the media plug, wherein the arch includes pin guides shaped to receive the contact pins; and a flexible shield at least partially extending into the aperture and wherein the shield extends beneath the contact pins such that the electrical connection formed when the fingers contact the contacts of the media plug is insulated.

9. A media connector as defined in claim 8, wherein the pin guides extend out from the arch such that each of the contact pins is positioned within a different pin guide and wherein the pin guides keep each of the contact pins from touching another contact pin.

10. A media connector as defined in claim 8, wherein the arch allows the contact pins to move within a prescribed range of motion.

11. A media connector as defined in claim 8, wherein the shield comprises an insulative material.

12. A media connector as defined in claim 11, wherein the shield is an extension of a flex circuit attached to the retractable member, the flex circuit providing the electrical coupling between the contact pins and the electronic device.

13. A media connector as defined in claim 8, wherein the shield has a length that extends past the one or more contact pins extending into the aperture such that the one or more contact pins are covered by the shield.

14. A media connector for forming an electrical connection with contacts of a media plug, the media connector comprising:

a retractable member, the retractable member including a body adjacent to an aperture, wherein the aperture is shaped and sized to removably receive the media plug;

one or more contact pins enclosed within the body, wherein fingers of the one or more contact pins exit the body of the retractable member and extend into the aperture, wherein the fingers are configured to come into electrical communication with the contacts of the media plug;

an arch disposed within the body and extending into a portion of the aperture, wherein the arch includes pin guides extending out from the arch such that each of the one or more contact pins rests within a different pin guide, and wherein the pin guides properly position the fingers extending into the aperture;

an arch channel within the body, the arch channel formed by an opposite face of the arch;

a groove, wherein the groove extends across an end of the arch, the groove having a width extending from the arch channel to the aperture; and a shield connected to the retractable member within the body, wherein the shield exits the body through the arch channel and wherein the shield has a length extending past the fingers such that the shield covers the electrical connection formed when the media plug is inserted in the aperture.

15. A media connector as defined in claim 14, wherein the shield comprises an insulative material.

16. A media connector as defined in claim 15, wherein the shield is an extension of a flex circuit connected with the retractable member.

17. A media connector as defined in claim 14, wherein the arch separates the shield from the one or more contact pins such that the shield does not interfere with a range of motion of the one or more contact pins.

18. A media connector as defined in claim 14, wherein the shield rests within the groove and the shield extends into the aperture beneath the one or more contact pins when the retractable member is retracted.

19. A media connector as defined in claim 14, wherein the shield insulates the electrical connection by exerting a force against the electrical connection.

20. A media connector as defined in claim 14, wherein the shield prevents the electrical connection from being touched.

* * * * *

UNITED STATES PATENT AND TRADEMARK OFFICE

CERTIFICATE OF CORRECTION

PATENT NO. : 6,398,565 B1 
DATED : June 4, 2002
INVENTOR(S) : Thomas A. Johnson et al.

It is certified that error appears in the above-identified patent and that said Letters Patent is hereby corrected as shown below:

Column 1,
Line 6, change "09/681,233" to -- 09/687,233 --

Signed and Sealed this

Twenty-sixth Day of August, 2003

JAMES E. ROGAN
*Director of the United States Patent and Trademark Office*